United States Patent [19]

Hupalowsky

[11] 4,174,781

[45] Nov. 20, 1979

[54] DISPENSING APPARATUS

[75] Inventor: Joseph Hupalowsky, Katonah, N.Y.

[73] Assignee: Wm. Wrigley Jr. Company, Chicago, Ill.

[21] Appl. No.: 870,861

[22] Filed: Jan. 19, 1978

[51] Int. Cl.[2] ..... A47F 7/00

[52] U.S. Cl. ..... 211/49 D

[58] Field of Search ..... 211/49, 54.1, 57.1, 211/59.1, 169, 170, 168, 13, 46; 312/60, 283, 324; 221/188, 312 A

[56] References Cited

U.S. PATENT DOCUMENTS

| | | | |
|---|---|---|---|
| 899,342 | 9/1908 | Smith | 312/136 |
| 1,104,207 | 7/1914 | McCracken | 221/29 X |
| 2,951,303 | 9/1960 | Hovlid | 211/45 X |
| 3,189,185 | 6/1965 | Grasso | 211/59.1 |
| 3,248,005 | 4/1966 | Joschko | 221/312 R X |
| 3,472,394 | 10/1969 | Svoboda et al. | 211/169 |
| 3,814,284 | 6/1974 | Flubacker | 221/312 X |
| 4,072,246 | 2/1978 | Paulin | 211/59.1 X |

*Primary Examiner*—William H. Schultz

[57] ABSTRACT

The present invention is directed to improvements in article merchandising apparatus and pertains particularly to a dispensing apparatus which may be readily loaded or charged with articles and, when thus loaded or charged, assures that the articles are dispensed in the sequence in which they are loaded, i.e. the first articles placed in the device will also be the first articles dispensed.

10 Claims, 9 Drawing Figures

DISPENSING APPARATUS

BACKGROUND OF THE INVENTION

1. Field of the Invention

The present invention is in the field of dispensing devices and pertains more particularly to dispensing racks or displays such as are used in supermarkets, chain stores and hardware stores, for example. The dispensing apparatus of the present invention is to be distinguished from vending machines in that in the latter devices removal of articles is controlled by insertion of a coin, etc.

2. The Prior Art

Conventionally, many prepacked articles, such as candy, chewing gum, cold cuts, batteries and the like are dispensed through the use of rack merchandising displays. By way of example, many supermarkets merchandise cold cuts which are prepackaged, the packages being slidably received on wires extending from a pegboard or like panel or bulkhead. The packages may include cardboard tabs or tags having apertures formed therein, enabling the packages to be slidably received on the wires or rods.

Obviously, it is desirable, where the article dispensed is a food product, electrical battery or like item having a limited shelf life, that the articles which are displayed at the earliest date also be the articles which are first sold or dispensed, i.e. that the merchandise operate on a first in-first out (FIFO) principle.

The typical dispensing device as above described is not conducive to FIFO operations in that store personnel charged with the responsibility for refilling a partially depleted supply of articles of a particular type may not take the time to remove the remaining supply of articles which had been previously on display, add the necessary fresh articles, and thereafter replace the previously displayed articles. There is an obvious temptation simply to press the remaining articles to the rear against the panel and add such quantity of fresh items at the front as may be required fully to replenish the supply. Such practice will, of course, result in the early sale of fresh items and the continued display of older items, with the result that the older items which have been pushed to the rear may become spoiled, degraded or shopworn.

While it is known in connection with vending apparatuses to provide elaborate and expensive mechanisms whereby a machine may be reloaded only in such manner as to assure a FIFO dispensing, the cost of such devices is prohibitive and such devices typically must be serviced by skilled personnel.

SUMMARY OF THE INVENTION

The present invention is directed to an inexpensive, efficient and attractive dispensing device which assures a seriatim (FIFO) distribution of articles which are to be dispensed. An important feature of the invention resides in the facility with which the same may be loaded whereby there is little or no incentive on the part of a stock clerk to shortcut the loading of the device in the manner discussed above.

More particularly, in accordance with an embodiment of the invention, the present apparatus comprises a continuous guide channel mounted on a panel, the channel including portions to the rear of the panel and to the front of the panel, the channel defining an arcuate half convolution about a lateral side edge of the panel.

The channel is inclined continuously downward in the direction from the rear to the front face of the channel.

The product to be dispensed is provided with a tag having a cutout adapted to be slidably received over the channel and gravitationally advanced down the channel to a dispensing position.

The device is loaded by adding merchandise over the channel at the rear surface of the panel, said rear or loading end of the channel being accessible either by bodily pivoting the channel or by providing a space between adjacent panels, permitting access by the stock clerk.

In accordance with an embodiment of the invention, a multiplicity of panels, each of which incorporates one or more dispensing channels or guides, is assembled to define a continuous coplanar assembly. The panels, in their coplanar aligned position, may be spaced apart a distance sufficient to provide access to the loading end of the channel or may be oriented in edge-to-edge engagement and pivotally mounted to provide such access.

In accordance with a further embodiment, the panels carrying the guides are mounted in parallel spaced relation, with edges of the panels facing the customer, access to the loading end of the channels being blocked by pivotally mounted flaps or closures.

In accordance with a further and preferred embodiment, a pair of modules may be provided, each said module including a cluster or multiplicity of feed channels, the channels of the noted embodiment being inclined in a direction from the rear face to the front face of the modules. Mounting means are provided whereby the rear or loading faces of the modules are juxtaposed and, hence, are inaccessible for loading or unloading from the rear faces. Mounting means are provided for pivoting the modules from their mutual blocking or juxtaposed dispensing position to a laterally displaced loading position at which access is afforded to the rear faces of the channels of the modules for loading.

Means may be provided in any of the above described embodiments for preventing a prospective customer or other unauthorized person from gaining access to the rear or loading end of the channels.

Accordingly, it is an object of the present invention to provide a simple, inexpensive and effective dispensing device wherein a first in-first out distribution of dispensed articles is assured.

A further object of the invention is the provision of an apparatus of the type described which includes an inclined guide channel adapted slidingly to support a suspension element affixed to an article to be dispensed, whereby the articles may naturally descend from a loading station to a dispensing station, the loading station preferably being inaccessible to prospective purchasers but readily accessible to stock clerks or other authorized persons.

A further object of the invention is the provision of an assembly which comprises a plurality of dispensing apparatuses of the type described, the apparatus being so constructed and arranged as to be shiftable between loading and dispensing positions, the devices in the loading position exposing the upstream or loading ends of the distribution chutes or channels to facilitate refilling by a stockist, the devices in the dispensing position having the loading ends shielded, whereby articles may not either inadvertently or intentionally be removed except from the dispensing end of the channels.

A further object of the invention is the provision of a dispensing device including elongate channels or tracks which are inclined to the horizontal and which, in cross section, provide connector means which enable the tracks or channels to be mounted to a support structure and support portions, the track members employing in combination therewith packages including slots or cutouts whereby the packages are enabled gravitationally to descend the tracks, the cutouts providing clearance for the connector portion of the track.

Still a further object of the invention is the provision of an improved dispensing assembly which includes at least two modules, each of which incorporates a plurality of dispensing tracks, the modules being relatively shiftable from a loading position whereat the loading ends of the tracks are accessible to permit facile restocking, and a dispensing position whereat the loading ends of the tracks of the modules are juxtaposed and, hence, inaccessible.

To attain these objects and such further objects as may appear herein or be hereinafter pointed out, reference is made to the accompanying drawings, forming a part hereof, in which.

Figure 1:
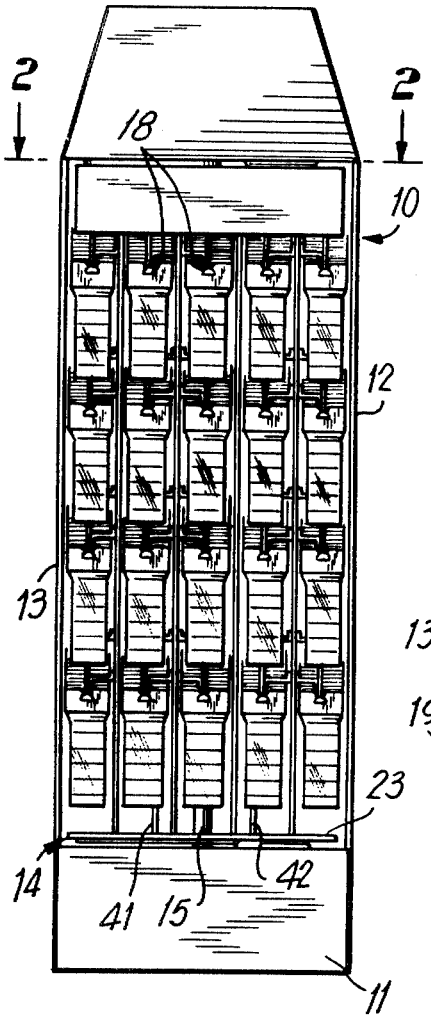
FIG. 1 is a perspective view of the dispensing face of a preferred embodiment of the invention.

Turning now to the drawings, there is shown in FIG. 1 a first form of dispensing device in accordance with the invention. The device includes a frame 10 which may be maintained in vertical position on a stanchion or base 11.

The frame includes side walls 12, 13. Optionally but preferably the frame may be pivotally connected to the stanchion 11 as by a turntable assembly 14 which includes a vertical mounting post 15. Mounted within the frame 10 there are disposed a pair of dispensing modules 16, 17, each of which modules carries a multiplicity of dispensing track or guide assemblies 18.

Each of the track assemblies 18 includes a track member 19 which may comprise a strip of extruded aluminum or the like of inverted T shape in cross section, and including a vertical connector web 20 and a horizontally disposed support web 21. The tracks 19 are mounted to a plurality of vertically extending, forwardly and rearwardly directed panels 22, the upper and lower ends of which panels are affixed to upper and lower end plates 23 of the modules 16 and 17. As the modules 16 and 17 are identical, a description of one will suffice.

The panels 22 carry offset bracket arms 24, including first vertical leg portions 25 bolted to the panels as by cross bolts 26, horizontally directed extension arms 27, and depending connection portions 28. The connector portions are fixed as by rivets 29 to the vertically upwardly directed connector legs or portions 20 of the tracks 19, the lowermost ends 30 of the connection portions 28 being spaced upwardly a distance from horizontal support portions 21 of the brackets.

Figure 4:
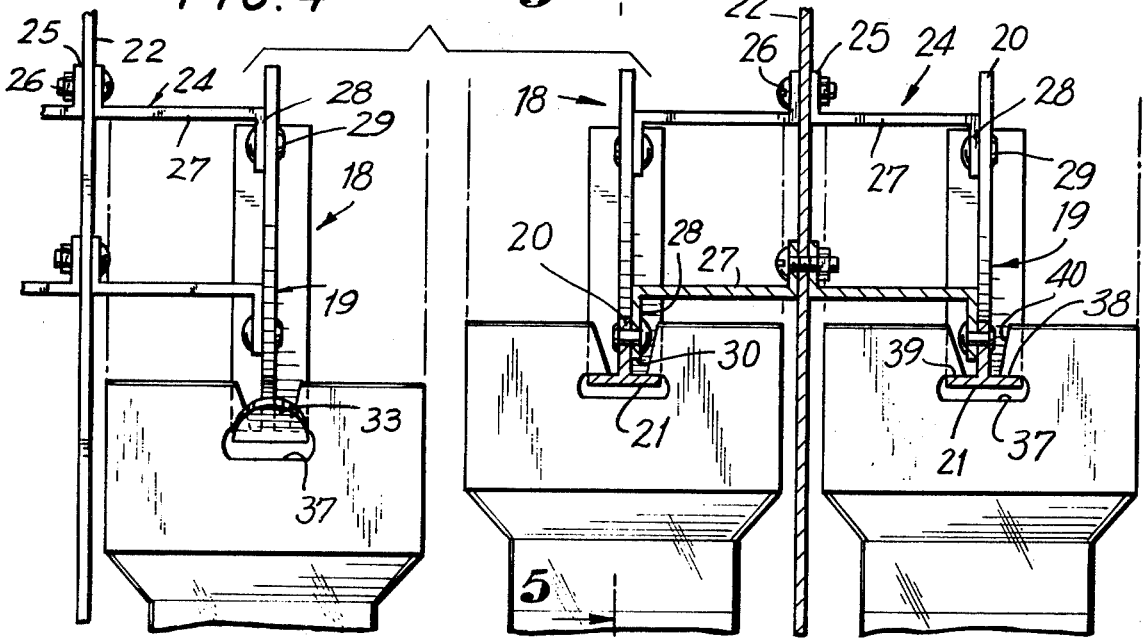
FIG. 4 is a magnified discontinuous vertical section taken on the line 4—4 of FIG. 2.
Figure 5:
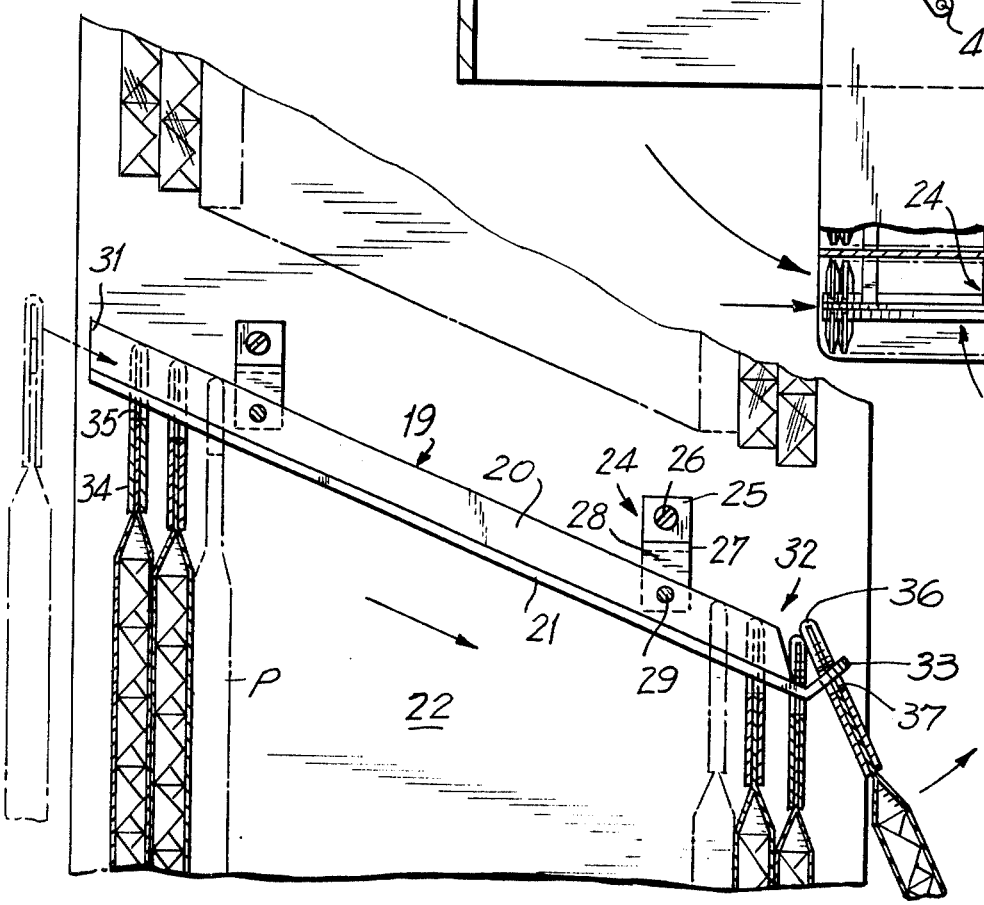
FIG. 5 is a vertical section taken on the line 5—5 of FIG. 4.

As will best be appreciated from an inspection of FIGS. 4 and 5, the tracks 19 are inclined from their loading ends 31 continuously downwardly toward their dispensing ends 32.

A detent or stop portion 33 formed by an upwardly curved portion of the track is disposed at the dispensing end, the stop portion 33 providing a limit to maintain a series of packages P from falling freely off of the dispensing end 32 of the tracks. The packages P are slidably mounted on the track so as to be loadable at the loading end 31 of the track and smoothly descend under gravitational influence until they are impeded at the lower or dispensing end 32 by the stop portion 33.

The packages, which may be filled with any of a wide variety of articles, e.g. candy, hardware items, packaged cold cuts, etc., preferably include carrier tags 34 at the upper ends thereof. The tags 34 may comprise cardboard members which are folded over the mouth portion 35 of the packages P, about a medial fold line, e.g. 36, the mouth portions of the packages being sealed either prior to application of the tags or by such application. It will be understood that the tags may be secured to the packages as by staples (not shown) run through the two layers of the tag, with the mouth portion 35 of the packages sandwiched between the two layers of the tag.

The tags are formed with transversely extending slots or cutouts 37 which permit the tags to be slidably received on the tracks 19 while providing clearance for the connector portion 30 of the tracks. In the illustrated embodiment, the cutout 37 may include a spaced pair of support shoulders 38, 39, separated by an upwardly open clearance slot portion 40 disposed therebetween.

From the foregoing description it will be evident that the modules may each include a plurality of rows and columns of vertically and horizontally spaced tracks 19, each of which tracks carries a plurality of packages.

The modules 16, 17 will be understood to include front dispensing faces 16', 17', at which faces are located the dispensing ends 32 of the tracks. The modules also include rear loading faces 16'', 17'', at which rear faces are located the loading ends 31 of the tracks. The modules 16 and 17 are supported by mechanism, next to be described, which normally maintains the same in a dispensing position, as depicted in FIG. 2, whereat the loading faces 16'' and 17'' are juxtaposed and, hence, inaccessible, the mechanism permitting shifting of the panels to the position shown in FIG. 3, whereat the loading faces 16'' and 17'' are exposed and are therefore readily accessible for restocking.

The support mechanism includes a first vertically directed rod or shaft 41, the distal ends of which are pivotally secured at spaced positions on the supporting frame or structure, the shaft 41 being rigidly fixed to the upper and lower end plates 23 of the modules 16. The module 17 is similarly pivotally suspended to the stanchion by the vertically directed shaft 42.

Figure 3:
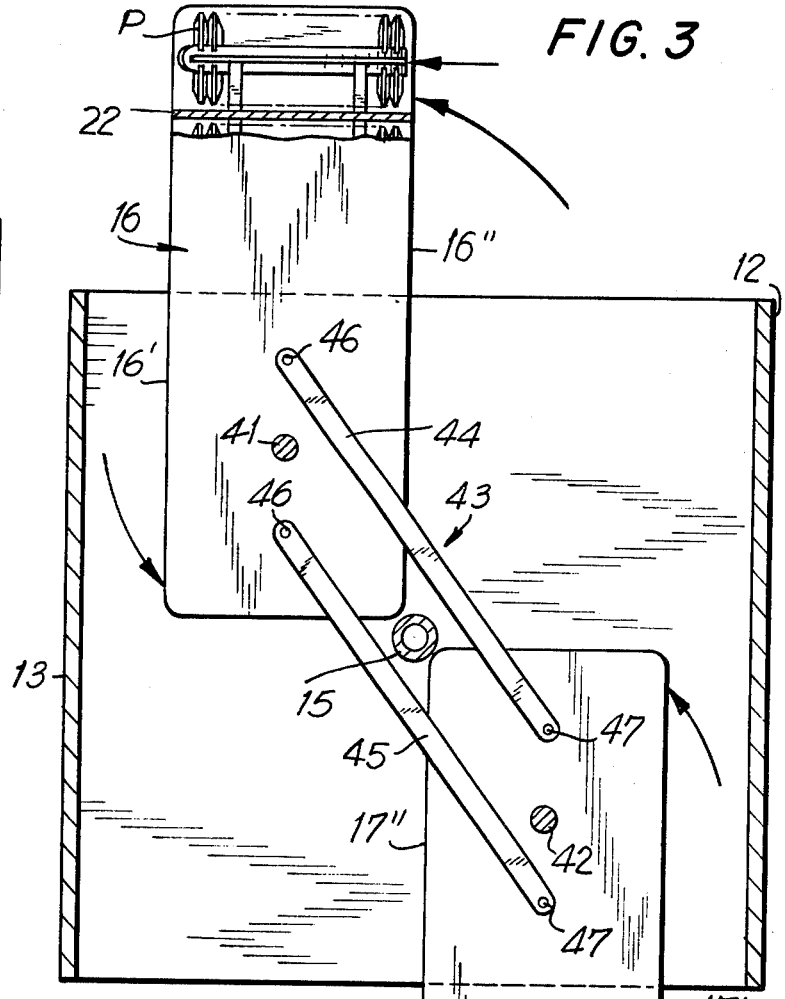
FIG. 3 is a view similar to FIG. 2 showing the modules in the loading position.

It will be recognized that the shafts 41, 42 are secured to the respective modules at positions offset from the vertical center lines thereof so that when they are pivoted to the position shown in FIG. 3 the loading faces 16", 17" are laterally offset from each other, such as to make the entirety of the said faces accessible for restocking.

Figure 2:
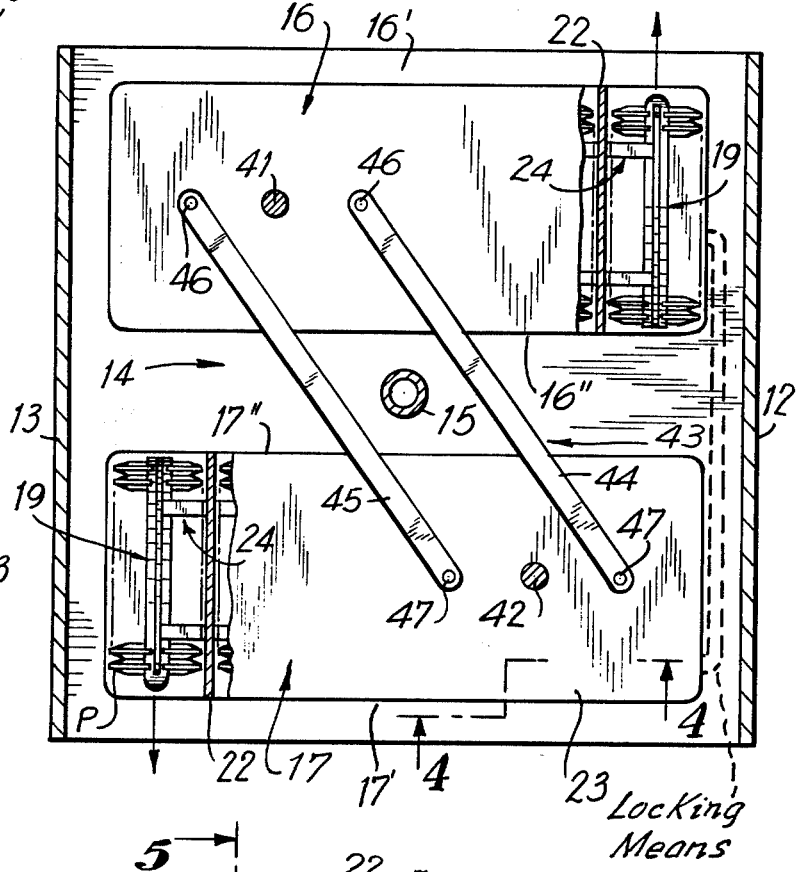
FIG. 2 is a magnified horizontal section thereof taken on the line 2—2 of FIG. 1, depicting the modules in the dispensing position.

Movement of the modules 16, 17 from the dispensing position of FIG. 2 to the stocking position of FIG. 3 is facilitated through the use of a parallelogram linkage assembly 43, next to be described.

The parallelogram assembly 43 includes a pair of parallel bars 44, 45, the distal ends of which are pivotally affixed to the upper end plates 23 of the respective modules as by pivot pins. The pivot pins 46, 46 are secured to the upper end plate 23 of module 16. In similar fashion, pivot pins 47, 47 are secured to the upper end plate of module 17. The points of connection of pivot pins 46 are equi-distant from the axis of the support rod 41. In similar fashion, the points of connection of the pivot pins 47 are equi-distant from support rod 42 of module 17. It will thus be observed that a pivotal movement imparted to either module 16 or 17, by virtue of the action of the parallelogram linkage 43, imparts concomitant and opposite pivotal movement to the other module, whereby movement between dispensing and loading position of either module results in a shifting of both modules. Preferably a second parallelogram linkage (not shown) aligned with the linkage 43 spans the bottom end plates 23 of the modules to assure tandem movement of the modules.

Optionally but preferably, a locking mechanism, FIG. 2, may be interposed between the modules 16 and 17 or between one of the modules and a fixed portion of the frame assembly, which locking mechanism will prevent relative movement of the modules to restrict unauthorized movement from the dispensing position to the loading position.

The operation of the apparatus will be evident from the preceding description.

Packaged articles P are loaded onto the various tracks 19 while the modules are positioned in the loading position shown in FIG. 3. Thereafter, the modules are pivoted to the dispensing position of FIG. 2 and preferably locked in said dispensing position.

Purchasers are able to remove the lowermost package from each track, which removal will permit the remaining packages in a row to descend under gravitational influence, providing access to the next lowermost package. In the normal course, when the supply of packaged articles becomes depleted or exhausted, the stockist merely releases the locking mechanism, pivots the modules to the position of FIG. 3, and replenishes the supply of articles to be dispensed.

Figure 6:
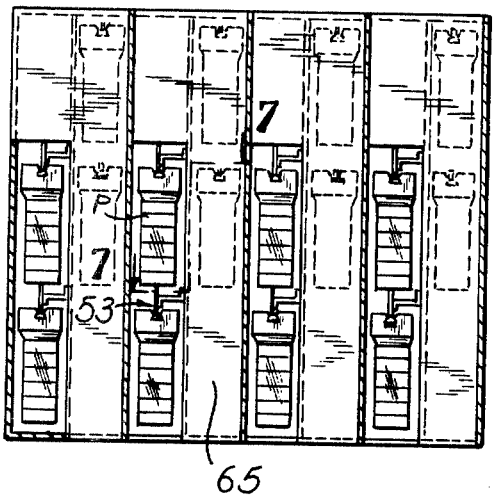
FIG. 6 is a front elevational view of a further embodiment of the invention.
Figure 7:
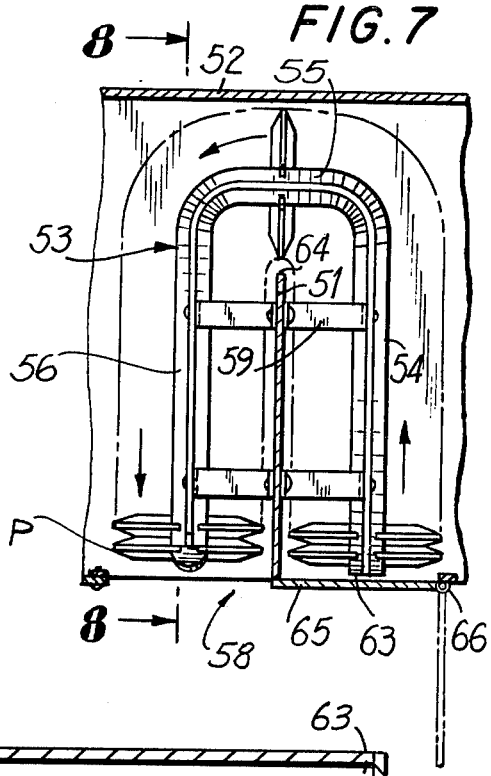
FIG. 7 is a slightly magnified discontinuous horizontal section taken on the line 7—7 of FIG. 6.
Figure 8:
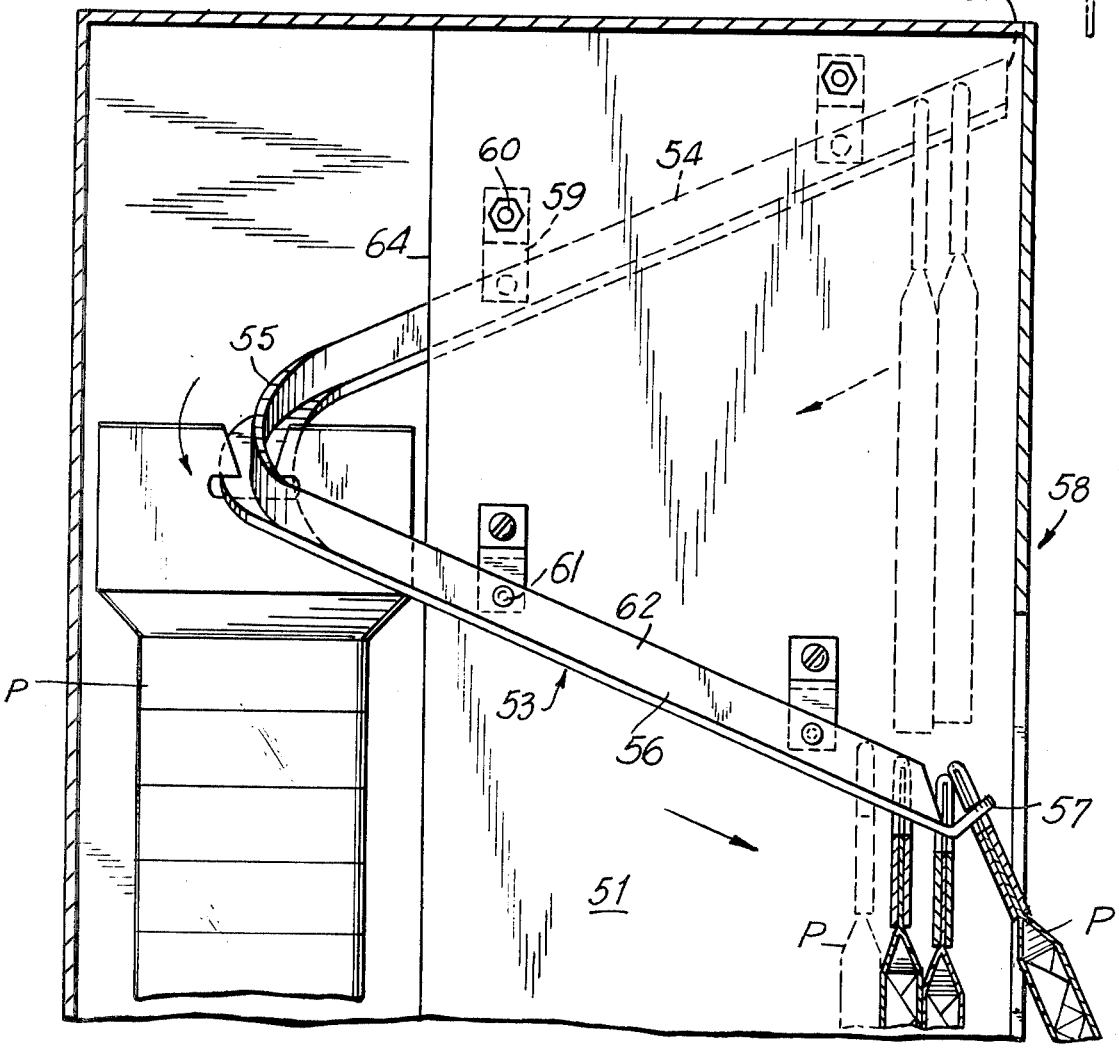
FIG. 8 is a magnified vertical section taken on the line 8—8 of FIG. 7.

In FIGS. 6 through 8 there is shown a further embodiment of the invention. In accordance with this embodiment there is provided an assembly comprising a plurality of vertically directed support panels 51, mounted in parallel spaced relation between horizontal components of a stand, stanchion or base. The assembly includes a rear bulkhead which may be the wall of the area in which the articles are to be dispensed.

The panel support track members 53 which, in cross section, are identical to the tracks 19 but which, in this instance, instead of being straight track sections, are arrayed in a general U shape in plan, so as to include a first or loading leg 54 which lies to one side of the panel 51, an arcuate or curved leg 55, and a dispensing leg 56 disposed at the opposite side of the panel from the leg 54 (see FIGS. 7 and 8). The track 53 is inclined downwardly continuously from the loading leg 54 to the dispensing leg 56, terminating at a dispensing detent stop 57 adjacent the front face 58 of the display.

The track 53 is secured to the panels by bracket members 59, the first end of which are secured as by bolts 60 to the panel 51, the other ends 61 of which are secured to the vertically directed web portions 62 of the track 53.

Packages P and the slotted openings formed at the head thereof, and their manners of interacting with the track to enable them to descend under gravitational influence are identical to those of the previously described embodiment and, accordingly, a detailed discussion thereof is not necessary. It is considered sufficient to state that the fresh items may be loaded at the loading end 63 of the tracks 53, and that such items will pass down the leg 54, around the curved leg 55 and down the dispensing leg to dispensing position adjacent the stop 57.

As best seen from FIG. 7, the curved leg portion 55 is spaced sufficiently far from the innermost end 64 of the panel 51 to provide clearance for the vertical edges of the packages nearest the panels.

It will be appreciated that a number of track assemblies may be secured to a single panel.

Restriction of access to the loading ends of the panels may be assured in various manners. Thus, loading flaps 65 may be secured as by hinges 66 to the frame assembly so as to be movable between dispensing (solid line) and loading (dot and dash line) positions as depicted in FIG. 7.

When the panels 65 are swung to the loading position, access is provided to the end 63 of the track and when the panels are shut, as for dispensing, only the dispensing ends of the tracks are accessible to the consumer.

Figure 9:
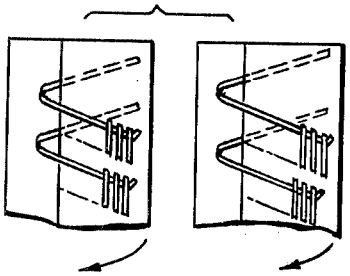
FIG. 9 is a front elevational view on a smaller scale of the panel elements of the embodiments of FIGS. 6 to 8 assembled in a somewhat different manner.

While the panels 51 are disclosed in the embodiment of FIGS. 6 through 8 as being in parallel spaced relation, it will be evident that the panels may alternatively be secured in an assembly in which they are aligned in a coplanar arrangement (FIG. 9). When the panels are utilized in the coplanar orientation, the panels themselves may be pivotally supported to the mounting or base mechanism to facilitate loading. The panels must be spaced apart to provide clearance for the passage of packages P between adjacent panels. It will be understood that when the panels are in coplanar alignment, one panel will act to shield from visual access the loading end of the next adjacent panel.

In loading the device, where the panels are pivoted, it is merely necessary to release the panels to enable them to be pivoted outwardly, whereby the stockist is afforded access to the loading end of the tracks. Where the panels are fixed, the stockist reaches into the space between adjacent panels for loading.

Numerous alternative arrangements of the individual panel assemblies of FIGS. 6 through 9 may be made. It will be observed that in the embodiment of FIGS. 6 to 8, the purchaser is afforded a front view of the packages carried by the tracks. Where the panels are to be utilized in the manner depicted in FIG. 9, it will be appreciated that the consumer looking toward the panels will be afforded only a side view of the packages. If such view does not provide sufficient identification of the product, it may be desirable to provide at the lowermost end of the track adjacent the dispensing end a 90° forward curve of the track, such that a face view of the first package is permitted.

It will be further recognized that the panel assemblies may be used singly and may be permanently affixed to a bulkhead in close proximity thereto. The clearance between the panel and the bulkhead need be only sufficient to permit free passage of packages down the track.

In the arrangements depicted, the panels themselves, in addition to functioning as a support for the guide tracks, also shield the loading ends of the tracks.

It will be readily recognized that the above described constructions provide a dispensing apparatus which assures a first in-first out distribution of a product and at the same time enables such facile loading that there is no incentive for a stock clerk to shortcut proper loading procedures by introducing fresh articles at the dispensing rather than the loading end of the device.

A particular advantage of the arrangement shown in FIGS. 6 through 9 lies in the fact that a backward pressure on the lowermost article to be dispensed will not, by virtue of the curve in the track, be effective readily to back up the articles to afford the opportunity for replacing a removed article back onto the track from which it had been removed. This aspect of the device is highly desirable in that it prevents a customer who has removed an article from one track from carelessly replacing the dispensed article onto a different and improper track, thereby obscuring the lead package of a different track and confusing subsequent purchasers.

Numerous variations of the described concept may be readily envisioned by those skilled in the art in the light of the instant disclosure. Accordingly, the invention is to be broadly construed within the scope of the appended claims.

Having thus described the invention and illustrated its use, what is claimed as new and is desired to be secured by Letters Patent is:

1. A dispenser apparatus comprising, in combination, a support frame, first and second dispenser modules mounted on said frame, said modules each including an outwardly directed front face and a rear face, a multiplicity of spaced parallel dispenser guides supported on said modules, said guides having a loading end adjacent said rear face and a dispensing end adjacent said front face of said modules and being downwardly inclined from said loading toward said dispensing end, said guides being adapted slidably to support articles to be dispensed, mounting means interposed between said modules and said frame for supporting said modules for movement between a dispensing position whereat the rear faces of said modules are parallel and juxtaposed and, hence, inaccessible, and a loading position whereat said modules are laterally offset, said mounting means comprising first and second vertical pivot means supporting said modules for rotation about laterally displaced vertical axes, and a parallelogram linkage having first and second ends operably connected to said first and second modules, respectively, the points of connection of each end of said linkage being equi-distant from the pivot axis of the respective module, whereby pivotal movement imparted to one said module imparts concomitant pivotal movement to the other said module, thereby to shift said modules between said loading and dispensing positions.

2. Apparatus in accordance with claim 1 wherein said guides comprise track members, said track members including in cross section a connector portion and an article support portion, support means extending between said connector portion and said modules, and a plurality of packaged articles mounted on said track members and gravitationally urged from said loading toward said dispensing ends, said packaged articles each including support shoulder means slidably engaging said support portions of said track members and a slot member adjacent said support portions providing clearance for said connector portions of said track members.

3. Apparatus in accordance with claim 3 and including lock means extending between said modules for preventing movement of said modules from said dispensing to said loading positions.

4. A dispenser apparatus comprising, in combination, a stanchion, a frame on said stanchion including end walls, said frame being open at the sides between said end walls, first and second dispenser modules mounted in said frame, each said module including a front face and a rear face, a multiplicity of spaced parallel dispenser guides mounted on said modules, said guides having a loading end adjacent said rear faces of said modules and a dispenser end adjacent said front face of said modules and being downwardly inclined from said loading toward said dispenser ends, first and second pivot means connecting said first and second modules, respectively, to said frame for pivotal movement about a vertical axis, said pivot means engaging said modules at positions offset from the lateral center lines thereof, whereby said modules may be pivoted about said pivot means relative to said frame between a dispensing position whereat said rear faces are juxtaposed and, hence, inaccessible, said loading ends are blocked by said end walls, and said front faces are exposed at said open sides, to a loading position whereat said rear faces having said loading ends are shifted outwardly through said open sides.

5. Apparatus in accordance with claim 4 wherein said guides comprise track members, said track members including in cross section a connector portion and an article support portion, support means extending between said connector portion and said modules, and a plurality of packaged articles mounted on said track members and gravitationally urged from said loading toward said dispensing ends, said packaged articles each including support shoulder means slidably engaging said support portions of said track members and a slot member adjacent said support portions providing clearance for said connector portions of said track members.

6. Apparatus in accordance with claim 5 and including lock means extending between said modules for preventing movement of said modules from said dispensing to said loading positions.

7. A dispensing apparatus comprising, in combination, a vertical panel member, an elongate continuous track member supported on said panel member, said track member being of uniform cross section and defining a depending narrow connector portion and a lateral support portion extending from said connector portion, said track member including a first leg running along a rear face of said panel from a position adjacent a first lateral side edge thereof to a second lateral side edge thereof, a curved portion extending about said second lateral side edge, and a second leg extending along the front face of said panel, a loading station defined at the distal end of said first leg and a dispensing station defined at the distal end of said second leg, said track member being inclined downwardly from said loading end to said dispensing end, connector means extending between said connecting portion of said track and said panel for supporting said track in spaced relation to said panel, a plurality of packaged articles arrayed along said track and gravitationally urged from said loading end to said dispensing end, said articles including at the upper edge thereof a rigid tag member having an upwardly open cutout portion sized slidably to receive said track, said cutout portion including a vertically directed slot providing clearance for said connector portion of said track and a laterally directed shoulder portion resting on said support portion of said track, said track being spaced from said panel to provide clearance between said panel and articles descending said track.

8. Apparatus in accordance with claim 7 wherein said loading end of said track terminates short of said first end of said panel.

9. Apparatus in accordance with claim 8 wherein said support portions of said track and said shoulders of said tag are mutually configurated to preclude tilting of said articles in a plane transversely of said track member.

10. A dispenser cluster comprising a frame, a plurality of dispensing apparatuses in accordance with claim 7 mounted to said frame for pivotal movement about spaced vertical axes, said apparatuses being pivotal between dispensing positions whereat said panels are arranged in coplanar alignment with the first lateral side edge of one said panel being disposed in proximate spaced relation to the second lateral side edge of the adjacent panel, and a loading position whereat said panels are disposed in offset planes.

* * * * *